US007136839B2

(12) United States Patent
Lee et al.

(10) Patent No.: US 7,136,839 B2
(45) Date of Patent: Nov. 14, 2006

(54) METHOD FOR REISSUING DIGITAL TOKENS IN AN OPEN METERING SYSTEM

(75) Inventors: David K. Lee, Monroe, CT (US); Frederick W. Ryan, Jr., Oxford, CT (US)

(73) Assignee: Pitney Bowes Inc., Stamford, CT (US)

( * ) Notice: Subject to any disclaimer, the term of this patent is extended or adjusted under 35 U.S.C. 154(b) by 845 days.

(21) Appl. No.: 09/906,196

(22) Filed: Jul. 16, 2001

(65) Prior Publication Data

US 2001/0037735 A1 Nov. 8, 2001

Related U.S. Application Data

(63) Continuation of application No. 08/575,110, filed on Dec. 19, 1995, now Pat. No. 6,285,990.

(51) Int. Cl.
*G07B 17/00* (2006.01)

(52) U.S. Cl. ..... 705/60; 705/62; 705/401; 705/404; 705/408; 705/410; 380/23; 380/24; 380/25; 380/51

(58) Field of Classification Search ..... 705/60, 705/62, 401, 404, 408, 410, 500; 380/23, 380/24, 25, 51
See application file for complete search history.

(56) References Cited

U.S. PATENT DOCUMENTS 4,699,531 A * 10/1987 Ulinski et al. ..... 400/74
4,725,718 A 2/1988 Sansone et al.
4,757,537 A 7/1988 Edelmann et al.
4,775,246 A 10/1988 Edelmann et al.
4,802,027 A 1/1989 Talmadge
4,809,185 A 2/1989 Talmadge
4,813,912 A 3/1989 Chickness et al. ..... 705/408
4,831,555 A 5/1989 Sansone
4,858,138 A 8/1989 Talmadge
4,873,645 A 10/1989 Hunter
5,173,862 A * 12/1992 Fedirchuk et al. ..... 705/408
5,177,790 A 1/1993 Hazard
5,319,562 A 6/1994 Whitehouse ..... 364/464.03

(Continued)

FOREIGN PATENT DOCUMENTS

EP 0782109 A2 7/1997

(Continued)

OTHER PUBLICATIONS

Alternative postage payment solutions, 2005, Author unknown.*

(Continued)

*Primary Examiner*—Elisca Pierre
*Assistant Examiner*—John M. Winter
(74) *Attorney, Agent, or Firm*—Charles R. Malandra, Jr.; Angelo N. Chaclas

(57) ABSTRACT

A method of reissuing digital tokens in an open system meter includes the steps of calculating a digital token using the predetermined postal information including addressee information, postage amount and piece count; debiting postal funds by the postage amount; issuing the digital token for generation of an indicia; storing the digital token and the predetermined postal information as part of a transaction record in a transaction record file indexed according to addressee information; determining that an indicia generated from the digital token has not been successfully printed on a mailpiece for a particular addressee; and reissuing the digital token from the transaction record in the transaction file to generate the indicia for another attempt to print the indicia on the mailpiece.

8 Claims, 8 Drawing Sheets

U.S. PATENT DOCUMENTS

| | | | | |
|---|---|---|---|---|
| 5,325,430 | A | 6/1994 | Smyth | |
| 5,363,447 | A | 11/1994 | Rager | |
| 5,365,466 | A | 11/1994 | Hazard | |
| 5,390,251 | A | 2/1995 | Pastor et al. | |
| 5,448,641 | A | 9/1995 | Pintsov et al. | |
| 5,454,038 | A | 9/1995 | Cordery et al. | |
| 5,655,023 | A | 8/1997 | Cordery et al. | 380/51 |
| 5,675,650 | A | 10/1997 | Cordery et al. | 380/23 |
| 5,787,406 | A | 7/1998 | Arsenault et al. | |
| 5,819,240 | A * | 10/1998 | Kara | 705/408 |
| 6,005,945 | A * | 12/1999 | Whitehouse | 380/51 |
| 6,285,990 | B1 * | 9/2001 | Lee et al. | 705/60 |

FOREIGN PATENT DOCUMENTS

| | | | |
|---|---|---|---|
| JP | 09-311962 | | 12/1997 |
| JP | 2005018737 | A * | 1/2005 |

OTHER PUBLICATIONS

McKenna "Tests for PC Postaw Scheduled for Mid '97", News bytes NewsNetwork, May 27, 1997.

Costlow: "AT&T, Microsoft take stakes in e-postage start-up"; Electronic Engineering Times Sep. 29, 1997, p. 20.

Claymon: Digital Stamps get Postal Service OK 2 Firms Licensed for Electronic Postage, San Jose Mercury News, (SJ), 10 Aug. 9.

"Stamp of Approval, (the US Postal Services uses Cylinks digital signature and registration technology for Internet postage service) (in short)(Company Business and Marketing) government activity) (Brief article)," Information Week, Aug. 16, 1999, p. 6.

Bass: "The Internet goes Postal—Snail mail at the speed of light? Get ready to purchase postage over the Web"; PC Computing, Sep. 1, 1999, v12, n9, p. 125.

"E-Postage Fails to Prove its Value (About 302,000 of estimated 44.7 mil SOHOs have embraced PC postage; eStamp and Stamps.com had losses in second quarter of this year)" Internet World, Nov. 1, 2000, p. 28.

* cited by examiner

METHOD FOR REISSUING DIGITAL TOKENS IN AN OPEN METERING SYSTEM

RELATED APPLICATIONS

This application is a continuation of U.S. Ser. No. 08/575,110 filed on Dec. 19, 1995, entitled "A Method For Reissuing Digital Tokens in An Open Metering System", now U.S. Pat. No. 6,285,990.

The present application is related to the following U.S. patent application Ser. Nos. 08/575,106, 08/575,107, 08/574,746, 08/574,745, 08/574,743, 08/575,112, 08/575,109, 08/575,104, 08/574,749 and 08/575,111, each filed concurrently herewith, and assigned to the assignee of the present invention.

FIELD OF THE INVENTION

The present invention relates to advanced postage payment systems and, more particularly, to advanced postage payment systems having pre-computed postage payment information.

BACKGROUND OF THE INVENTION

The USPS is presently considering requirements for two metering device types: closed systems and open systems. In a closed system, the system functionality is solely dedicated to metering activity. Examples of closed system metering devices, also referred to as postage evidencing devices (PEDs), include conventional digital and analog postage meters wherein a dedicated printer is securely coupled to a metering or accounting function. In a closed system, since the printer is securely coupled and dedicated to the meter, printing cannot take place without accounting. Furthermore, printing occurs immediately after accounting is concluded.

In an open system, the printer is not dedicated to the metering activity, freeing system functionality for multiple and diverse uses in addition to the metering activity. Examples of open system metering devices include personal computer (PC) based devices with single/multi-tasking operating systems, multi-user applications and digital printers. An open system metering device is a PED with a non-dedicated printer that is not securely coupled to a secure accounting module.

When a PED prints a postage indicia on a mailpiece, the accounting register within the PED must always reflect that the printing has occurred. Postal authorities generally require the accounting information to be stored within the postage meter in a secure manner with security features that prevent unauthorized and unaccounted for postage printing or changes in the amounts of postal funds stored in the meter. In a closed system, the meter and printer are integral units, i.e., interlocked in such a manner as to ensure that the printing of a postage indicia cannot occur without accounting.

Since an open system PED utilizes a printer that is not used exclusively for printing proof of postage payment, additional security measures are required to prevent unauthorized printing evidence of postage payment. Such security measures include cryptographic evidencing of postage payment by PEDs in the open and closed metering systems. The postage value for a mail piece may be encrypted together with other data to generate a digital token. A digital token is encrypted information that authenticates the information imprinted on a mail piece including postage values.

Examples of systems for generating and using digital tokens are described in U.S. Pat. Nos. 4,757,537, 4,831,555, 4,775,246, 4,873,645,and 4,725,718,the entire disclosures of which are hereby incorporated by reference. These systems employ an encryption algorithm to encrypt selected information to generate at least one digital token for each mailpiece. The encryption of the information provides security to prevent altering of the printed information in a manner such that any misuse of the tokens is detectable by appropriate verification procedures.

Typical information which may be encrypted as part of a digital token includes origination postal code, vendor identification, data identifying the PED, piece count, postage amount, date, and, for an open system, destination postal code. These items of information, collectively referred to as Postal Data, when encrypted with a secret key and printed on a mail piece provide a very high level of security which enables the detection of any attempted modification of a postal revenue block or a destination postal code. A postal revenue block is an image printed on a mail piece that includes the digital token used to provide evidence of postage payment. The Postal Data may be printed both in encrypted and unencrypted form in the postal revenue block. Postal Data serves as an input to a Digital Token Transformation which is a cryptographic transformation computation that utilizes a secret key to produce digital tokens. Results of the Digital Token Transformation, i.e., digital tokens, are available only after completion of the Accounting Process.

Digital tokens are utilized in both open and closed metering systems. However, for open metering systems, the non-dedicated printer may be used to print other information in addition to the postal revenue block and may be used in activity other than postage evidencing. In an open system PED, addressee information is included in the Postal Data which is used in the generation of the digital tokens. Such use of the addressee information creates a secure link between the mailpiece and the postal revenue block and allows unambiguous authentication of the mail piece.

A typical problem for postage meters in general is when the meter accounting function debits the available postage funds of the meter but the indicia has not been successfully printed. Usually, the only way to recover such postage funds is to take mailpieces with misprinted indicia to the Post for a refund. For open and closed metering systems, whenever a digital token is issued by the metering function, the metering function debits the available postage funds before an indicia is printed. Therefore, even with new meters employing digital printing of indicia, the same problem exists.

SUMMARY OF THE INVENTION

It has been discovered that in an open metering system a digital token can be reissued from the metering system if the digital token is never printed or if a problem occurs preventing a printing of an indicia with the token. It has further been discovered that the security of the open system indicia is not compromised by such reissue of a token.

The present invention provides a method for reissuing a digital token for an open metering system, such as a PC-based metering system that comprises a PC, special Windows-based software, a printer and a plug-in peripheral as a vault to store postage funds. The PC meter uses a personal computer and its non-secure and non-dedicated printer to generate digital tokens and later print evidence of postage on envelopes and labels at the same time it prints a recipient address.

The present invention provides a token generation process for an open metering system that includes security that prevents tampering and false evidence of postage payment. The present invention further provides a token generation process that includes the ability to do batch processing of digital tokens.

In accordance with the present invention a method of reissuing digital tokens in a open system meter includes the steps of calculating a digital token using the predetermined postal information including addressee information, postage amount and piece count; debiting postal funds by the postage amount; issuing the digital token for generation of an indicia; storing the digital token and the predetermined postal information as part of a transaction record in a transaction record file indexed according to piece count; determining that an indicia generated from the digital token has not been successfully printed on a mailpiece for a particular addressee; and reissuing the digital token from the transaction record in the transaction file to generate the indicia for another attempt to print the indicia on the mailpiece.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
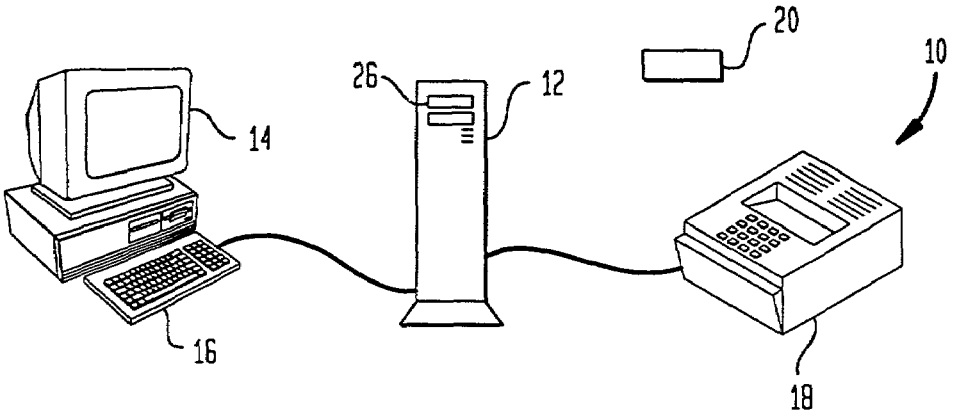
FIG. 1 is a block diagram of a PC-based metering system in which the present invention operates.

In describing the present invention, reference is made to the drawings, wherein there is seen in FIGS. 1–4 an open system PC-based postage meter, also referred to herein as a PC meter system, generally referred to as 10, in which the present invention performs the digital token process. PC meter system 10 includes a conventional personal computer configured to operate as a host to a removable metering device or electronic vault, generally referred to as 20, in which postage funds are stored. PC meter system 10 uses the personal computer and its printer to print postage on envelopes at the same time it prints a recipient's address or to print labels for pre-addressed return envelopes or large mailpieces. It will be understood that although the preferred embodiment of the present invention is described with regard to a postage metering system, the present invention is applicable to any value metering system that includes a transaction evidencing.

As used herein, the term personal computer is used generically and refers to present and future microprocessing systems with at least one processor operatively coupled to user interface means, such as a display and keyboard, and storage media. The personal computer may be a workstation that is accessible by more than one user.

The PC-based postage meter 10 includes a personal computer (PC) 12, a display 14, a keyboard 16, and an non-secured digital printer 18, preferably a laser or ink-jet printer. PC 12 includes a conventional processor 22, such as the 80486 and Pentium processors manufactured by Intel, and conventional hard drive 24, floppy drive(s) 26, and memory 28. Electronic vault 20, which is housed in a removable card, such as PCMCIA card 30, is a secure encryption device for postage funds management, digital token generation and traditional accounting functions. PC meter system 10 may also include an optional modem 29 which is located preferably in PC 12. Modem 29 may be used for communicating with a Postal Service or a postal authenticating vendor for recharging funds (debit or credit). In an alternate embodiment the modem may be located in PCMCIA card 30.

PC meter system 10 further includes a Windows-based PC software module 34 (FIGS. 3 and 4) that is accessible from conventional Windows-based word processing, database, accounting and spreadsheet application programs 36. PC software module 34 includes a vault dynamic link library (DLL) 40, a user interface module 42, and a plurality of sub-modules that control the metering functions. DLL module 40 securely communicates with vault 20 and provides an open interface to Microsoft Windows-based application programs 36 through user interface module 42. DLL module 40 also securely stores an indicia image and a copy of the usage of postal funds of the vault. User interface module 42 provides application programs 36 access to an electronic indicia image from DLL module 40 for printing the postal revenue block on a document, such as an envelope or label. User interface module 42 also provides application programs the capability to initiate remote refills and to perform administrative functions.

Thus, PC-based meter system 10 operates as a conventional personal computer with attached printer that becomes a postage meter upon user request. Printer 18 prints all documents normally printed by a personal computer, including printing letters and addressing envelopes, and in accordance with the present invention, prints postage indicia.

Figure 2:
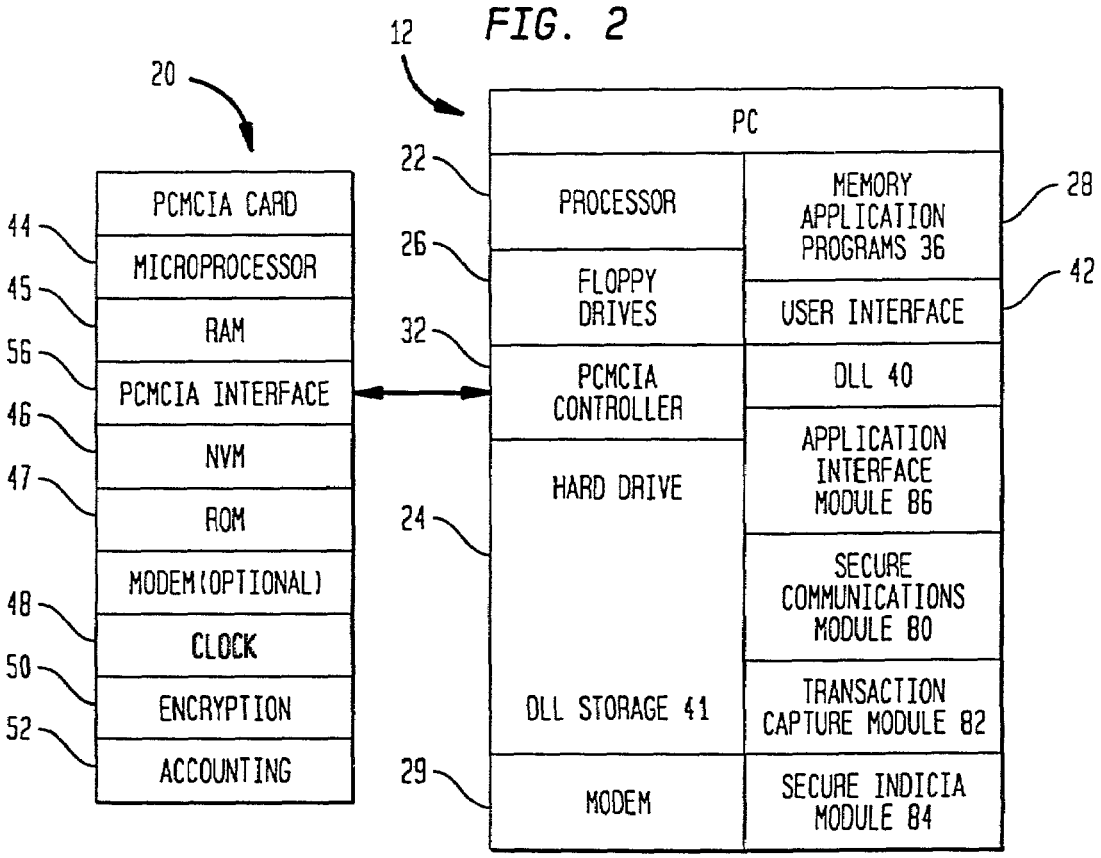
FIG. 2 is a schematic block diagram of the PC-based metering system of FIG. 1 including a removable vault card and a DLL in the PC.
Figure 3:
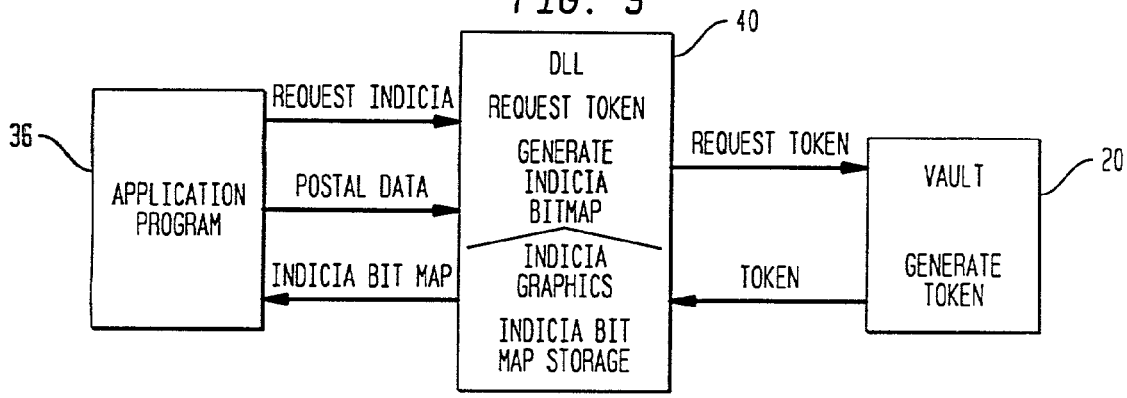
FIG. 3 is a schematic block diagram of the DLL in the PC-based metering system of FIG. 1 including interaction with the vault to issue and store digital tokens.
Figure 4:
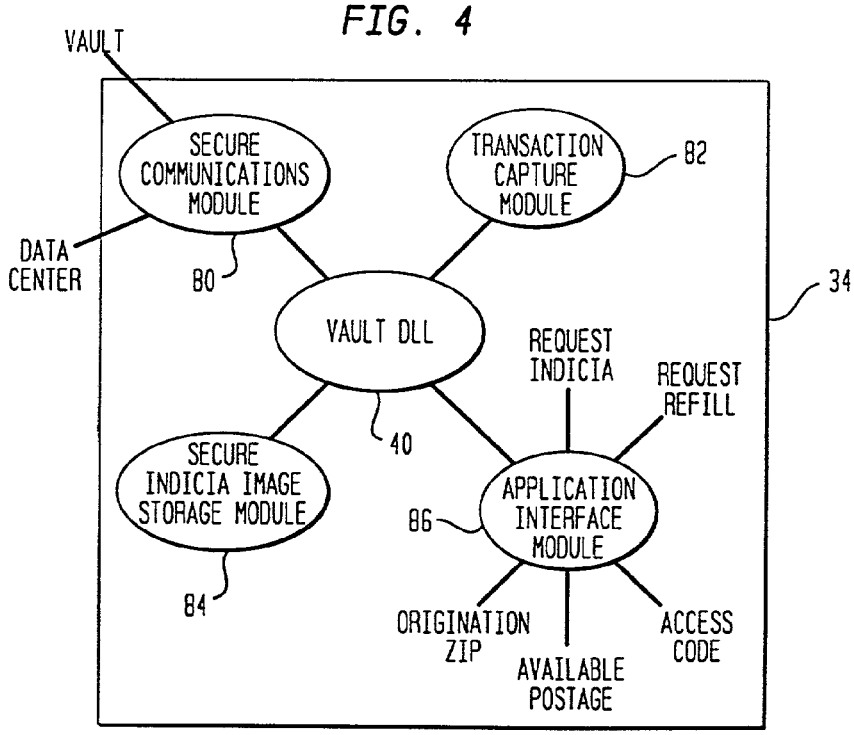
FIG. 4 is a block diagram of the DLL sub-modules in the PC-based metering system of FIG. 1.

The vault is housed in a PCMCIA I/O device, or card, 30 which is accessed through a PCMCIA controller 32 in PC 12. A PCMCIA card is a credit card size peripheral or adapter that conforms to the standard specification of the Personal Computer Memory Card International Association. Referring now to FIGS. 2 and 3, the PCMCIA card 30 includes a microprocessor 44, redundant non-volatile memory (NVM) 46, clock 48, an encryption module 50 and an accounting module 52. The encryption module 50 may implement the NBS Data Encryption Standard (DES) or another suitable encryption scheme. In the preferred embodiment, encryption module 50 is a software module. It will be understood that encryption module 50 could also be a separator device, such as a separate chip connected to microprocessor 44. Accounting module 52 may be EEPROM that incorporates ascending and descending registers as well as postal data, such as origination ZIP Code, vendor identification, data identifying the PC-based postage meter 10, sequential piece count of the postal revenue block generated by the PC-based postage meter 10, postage amount and the date of submission to the Postal Service. As is known, an ascending register in a metering unit records the amount of postage that has been dispensed, i.e., issued by the vault, in all transactions and the descending register records the value, i.e., amount of postage, remaining in the metering unit, which value decreases as postage is issued.

The hardware design of the vault includes an interface 56 that communicates with the host processor 22 through PCMCIA controller 32. Preferably, for added physical security, the components of vault 20 that perform the encryption and store the encryption keys (microprocessor 44, ROM 47 and NVM 46) are packaged in the same integrated circuit device/chip that is manufactured to be tamper proof. Such packaging ensures that the contents of NVM 46 may be read only by the encryption processor and are not accessible outside of the integrated circuit device. Alternatively, the entire card 30 could be manufactured to be tamper proof.

The memory of each NVM 46 is organized into sections. Each section contains historical data of previous transactions by vault 20. Examples of the types of transactions include: postage dispensed, tokens issued, refills, configuration parameters, and postal and vendor inspections. The size of each section depends on the number of transactions recorded and the data length of the type of transaction. Each section in turn is divided into transaction records. Within a section, the length of a transaction record is identical. The structure of a transaction record is such that the vault can check the integrity of data.

The functionality of DLL 40 is a key component of PC-base meter 10. DLL 40 includes both executable code and data storage area 41 that is resident in hard drive 24 of PC 12. In a Windows environment, a vast majority of applications programs 36, such as word processing and spreadsheet programs, communicate with one another using one or more dynamic link libraries. PC-base meter 10 encapsulates all the processes involved in metering, and provides an open interface to vault 20 from all Windows-based applications capable of using a dynamic link library. Any application program 36 can communicate with vault microprocessor 44 in PCMCIA card 30 through DLL 40.

DLL 40 includes the following software sub-modules. Secure communications sub-module 80 controls communications between PC 12 and vault 20. Transaction captures sub-module 82 stores transaction records in PC 12. Secure indicia image creation and storage sub-module 84 generates an indicia bitmap image and stores the image for subsequent printing. Application interface sub-module 86 interfaces with non-metering application programs and issues requests for digital tokens in response to requests for indicia by the non-metering application programs. A more detailed description of PC meter system 10 is provided in related U.S. patent application Ser. No. 08/575,112 filed concurrently herewith.

Since printer 18 is not dedicated to the metering function, issued digital tokens may be requested, calculated and stored in PC 12 for use at a later time when, at a user's discretion, corresponding indicia are generated and printed. Such delayed printing and batch processing is described in more detail in co-pending U.S. patent application Ser. No. 08/575,104, which is incorporated herein in its entirety by reference.

DIGITAL TOKEN GENERATION PROCESS

In accordance with the present invention, when a request for digital token is received from PC 12, vault 20 calculates and issues at least one digital token to PC 12 in response to the request. The issued digital token is stored as part of a transaction record in PC 12 for printing at a later time. In the preferred embodiment of the present invention, the transaction record is stored in a hidden file in DLL storage area 41 on hard drive 24. Each transaction record is indexed in the hidden file according to addressee information. It has been discovered that this method of issuing and storing digital tokens provides an additional benefit that one or more digital tokens can be reissued whenever a token has not been printed or if a problem has occurred preventing a printing of an indicia with the token.

By storing digital tokens as part of transaction records in PC 12 the digital tokens can be accessed at a later time for the generation and printing of indicia which is done in PC 12. Furthermore, if a digital token is lost, i.e., not properly printed on a mailpiece, the digital token can be reissued from DLL 40 rather than from vault 20. The storage of transaction records that include vault status at the end of each transaction provides a backup to the vault with regard to accounting information as well as a record of issued tokens. The number of transaction records stored on hard drive 24 may be limited to a predetermined number, preferably including all transactions since the last refill of vault 20.

Figure 5A:
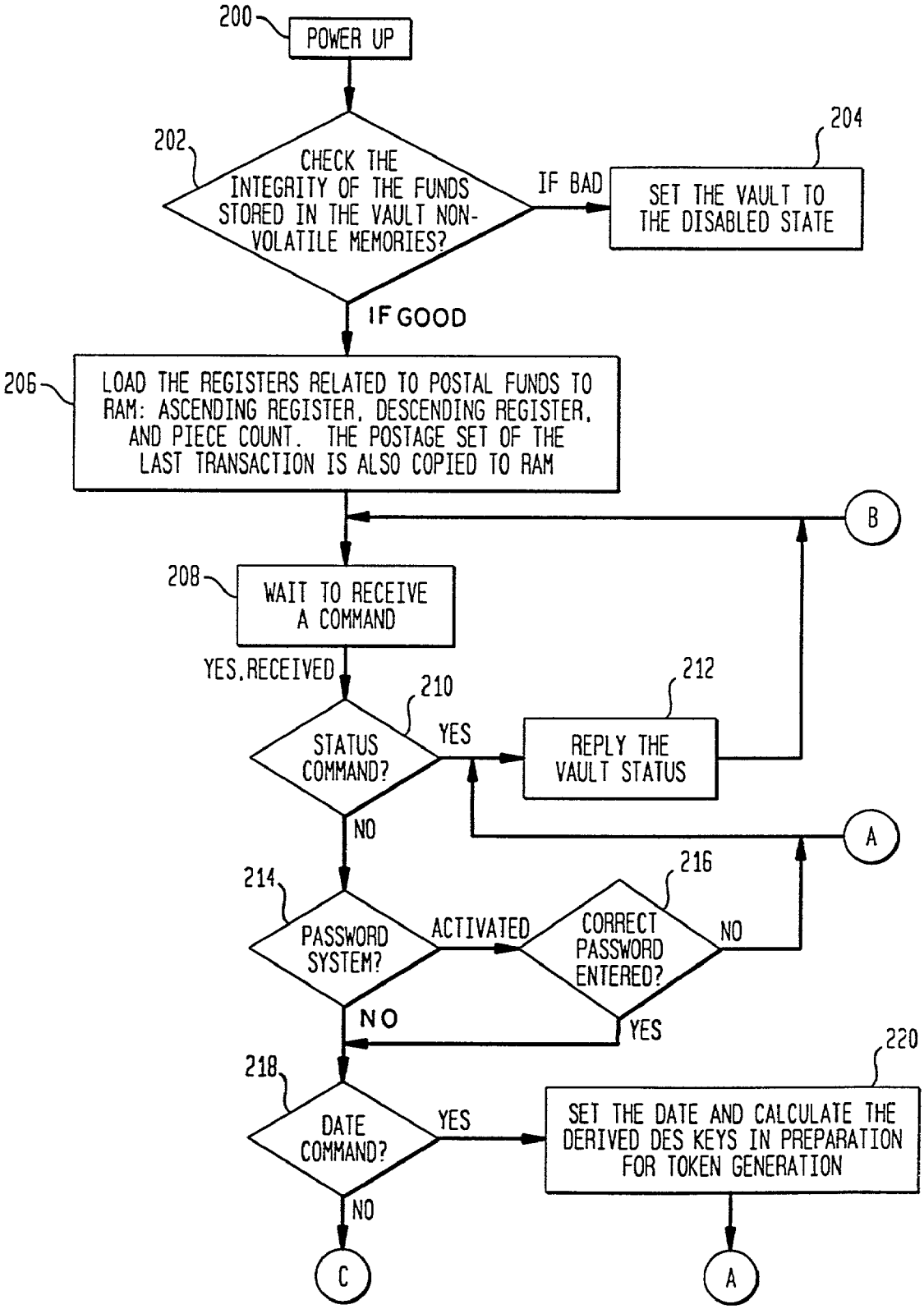
FIG. 5 (5A–5C) is a flow chart of a digital token generation process of the present invention.
Figure 5B:
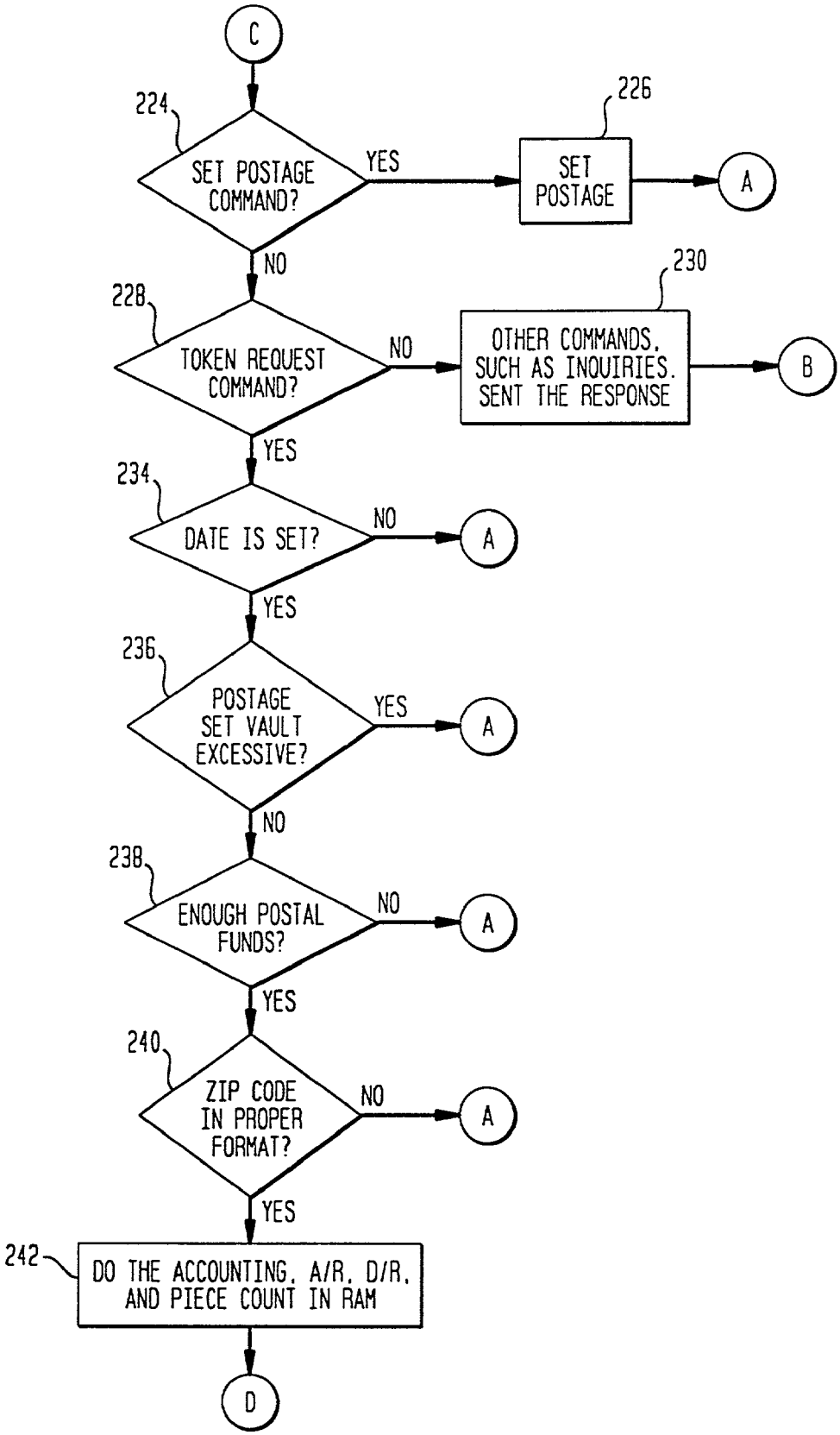
Figure 5C:
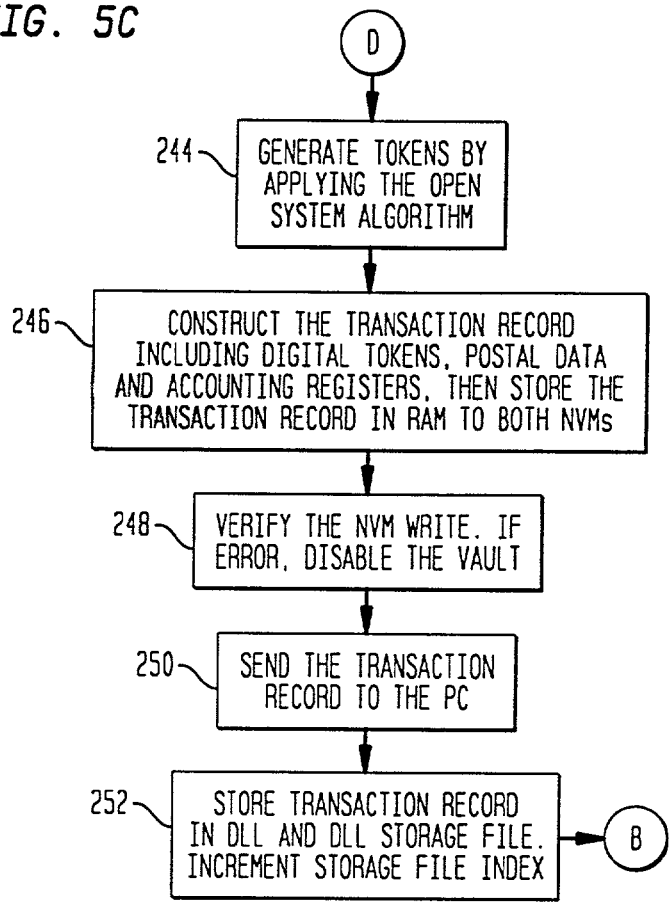

Referring now to FIG. 5, when power is applied, at step 200, to vault 20, i.e. when card 30 is inserted into controller 32, the vault initializes itself. At step 202, vault 20 checks the integrity of the funds stored in the redundant NVM 46. If bad, vault 20 sets itself into a disabled state, at step 204. If the NVM data is correct, then, at step 206, the registers related to postal funds, i.e., the ascending, descending and piece count registers, are loaded to RAM 45 and the most recent transaction record is also loaded into RAM 45. After verifying the data integrity of NVM 46 and copying the most recent records into vault's RAM 45, vault 20 is initialized and thereafter waits for an external command, at step 208.

When a status command is received, at step 210, vault 20 replies to PC 12 with its current status, at step 212. If a password is required to access vault 20 functions, at step 216 an entered password is checked for correctness.

When a command to set the date is received, at step 218, for the first time in a particular month, the vault, at step 220, sets the date and derives token generation keys for the month from master keys stored in NVM 46 of the vault. The vault then enables itself and is ready to receive a token request command. Once the date is set, when another date set command is received in the same month, the vault simply acknowledges the command and sets the date without recalculating the token generation keys. At step 224, a postage command is received and a postage value, for example, $0.32, is set at step 226.

When a token request command comprising a destination postal code is received by vault 20, at step 228, it checks the format of and the range of values in the request at steps 234–240. If the request is improper, vault 20 rejects the request and sends a status message to user application program 36 via DLL 40 at step 212. Vault 20 checks the date in the request, at step 234, and then compares, at step 236, the requested postage amount with the two warning values: high value warning and the postage limit amount. If the request exceeds the warning values, the request is rejected. Vault 20 then compares, at step 238, the requested postage amount with available postal funds in the descending register. If the amount of available postal funds is smaller than the requested amount, the vault rejects the token request command and sends an appropriate message to user application program 36 via DLL 40. If the amount of available postal funds is greater than or equal to the requested amount, vault 20 checks the destination information at step 240.

Finally, at step 242 vault 20 begins the accounting process to issue a digital token. Vault 20 deducts the requested postage amount from the available postal funds, i.e., adds the amount to the ascending register and subtracts the amount from the descending register, in RAM. At step 244 a digital token is calculated using an open system algorithm which includes addressee information. At step 246, vault 20 constructs in RAM 45 a transaction record that includes the piece count and the calculated token and stores the transaction record in an indexed file in the redundant NVM 46. In the preferred embodiment, the NVM transaction file is indexed by piece count. After storing to NVM, vault 20 checks, at step 248, the integrity of NVM 46 to confirm that the data is stored correctly. If an error occurs during this process, tokens are not issued and an error message is reported to the host processor in PC 12. If no error occurs, a transmission buffer that consists of the transaction record is assembled and vault 20 transmits, at step 250, the transaction record to DLL 40 in PC 12. If vault 20 does not receive a positive acknowledgment from PC 12, vault 20 retransmits the message.

Figure 6:
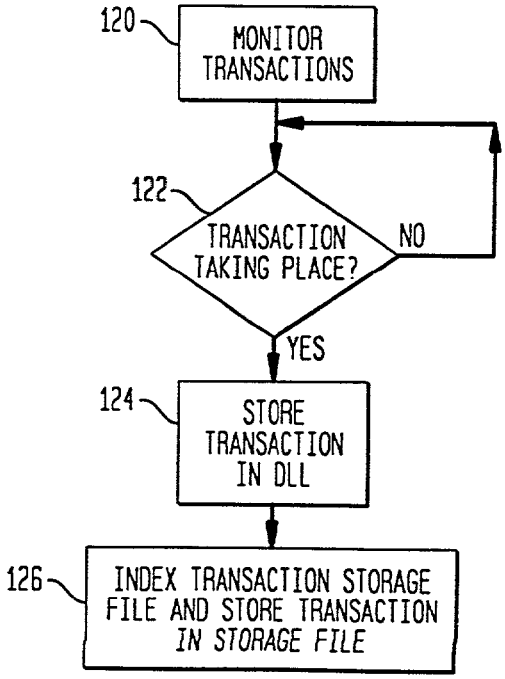
FIG. 6 is a flow chart of the Transaction Capture sub-module in the PC-based metering system of FIG. 1.

Conventional postage meters store transactions in the meter. In accordance with the present invention, Transaction Capture sub-module 82 captures each transaction record received from vault 20 and records the transaction record in DLL 40 and in DLL storage area 41 on hard drive 24 for a historical record. If there is ample room on hard drive 24, such transaction captures can be stored for a plurality of different vaults. Referring now to FIG. 6, from the moment that a communication session is established, Transaction Capture sub-module 82 monitors message traffic at step 120, selectively captures each transaction record for token generations and refills, and stores such transaction records in DLL 40 at step 124 in an invisible and write-protected file 83 in DLL storage area 41 at step 126. The information stored for each transaction record includes, for example, vault serial number, date, piece count, postage, postal funds available (descending register), tokens, destination postal code and a block check character. A predetermined number of the most recent records initiated by PC 12 are stored in file 83 which is an historical file indexed according to piece count. File 83 represents the mirror image of vault 20 at the time of the transaction except for the encryption keys and configuration parameters. Storing transaction records on hard drive 24 provides backup capability which is described below. In accordance with the present invention transaction records are maintained for a plurality of issued digital tokens for a predetermined time or count.

Figure 7:
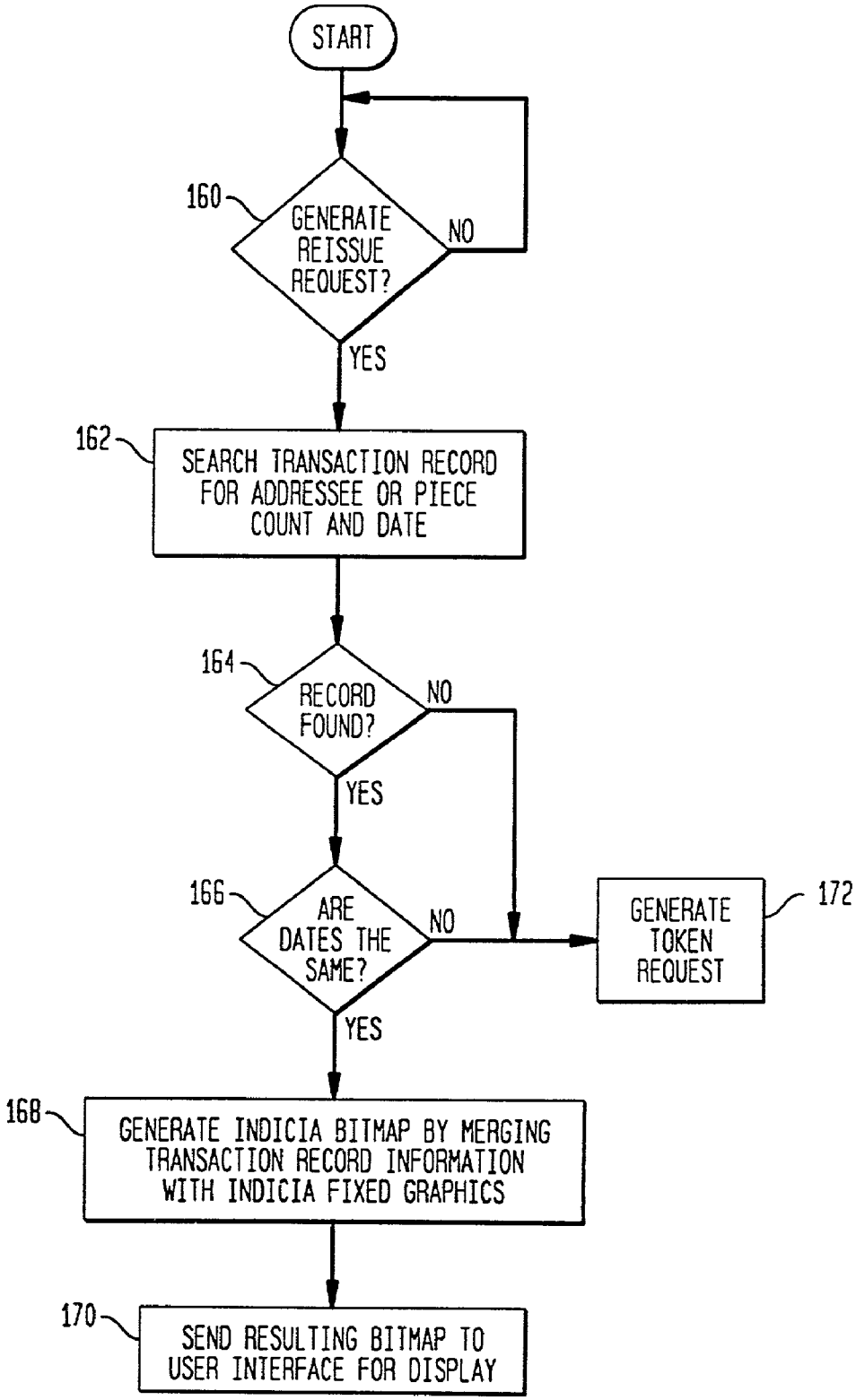
FIG. 7 is a flow chart of a token reissue process in the PC-based metering system of FIG. 1.

Referring now to FIG. 7, a check is made in PC 12 at step 160 for a token reissue request. When detected a search is made in the transaction record file 83 for an addressee, or piece count, and date corresponding to the token requested for reissue. If a transaction record is found, at step 164, for the requested addressee, then a check is made, at step 166, to verify that the requested date and the transaction record date are the same. If the dates are the same, at step 168, the indicia bitmap is generated using the transaction record found at step 164. The generated indicia bitmap is sent to the user interface at step 170. If no record is found, at step 164, for the requested addressee, or if the dates are not the same, at step 166, then a token request is issued, at step 172, for a new token.

Figure 9:
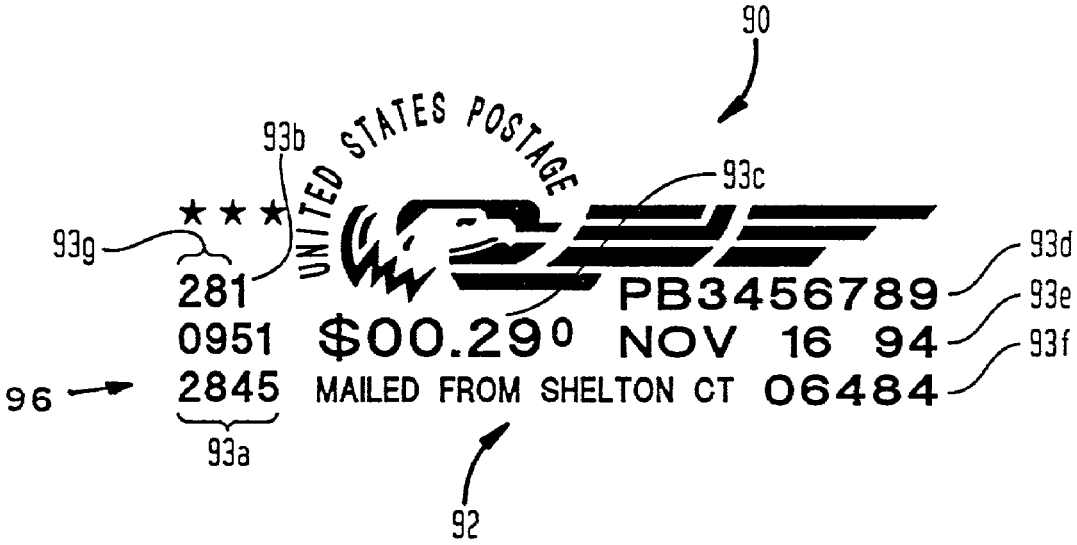
FIG. 9 is an representation of indicia generated and printed by the PC-based metering system of FIG. 1.

In accordance with the present invention, the entire fixed graphics image 90 of the indicia 92, shown in FIG. 9 is stored as compressed data 94 in DLL storage area 41. Postal data information, including piece count 93*a*, vendor ID 93*b*, postage amount 93*c*, serial number 93*d*, date 93*e* and origination ZIP 93*f* and tokens 93*g* are combined with the fixed graphics image 90 by Indicia Image Creation Module 84.

Figure 8:
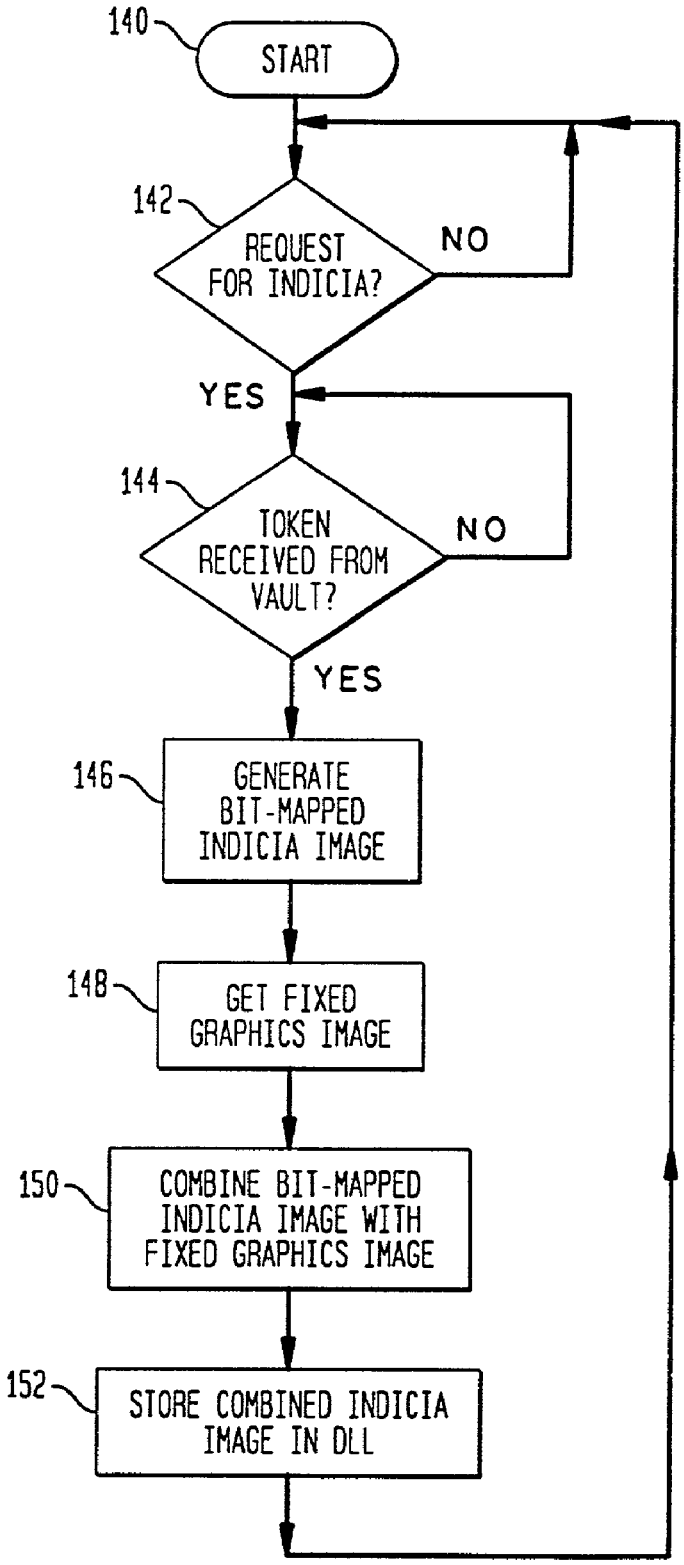
FIG. 8 is a flow chart of the PC generating an indicia image for a digital token in the PC-based metering system of FIG. 1.

Referring now to FIG. 8, when a request for indicia is made from an application program in PC 12 at step 142, Indicia Image Creation Module 84 checks for a digital token from vault 20 at step 144, and at step 146 generates a bit-mapped indicia image 96 by expanding the compressed fixed graphics image data 94 at step 148 and combining at step 150 the indicia's fixed graphics image 90 with some or all of the postal data information and tokens received from vault 20. At step 152, the indicia image is stored in DLL 40 for printing. Sub-module 84 sends to the requesting application program 36 in PC 12 the created bit-mapped indicia image 96 that is ready for printing, and then stores a transaction record comprising the digital tokens and associated postal data in DLL storage area 41. At this time, the indicia can be printed immediately or at a later time.

Thus, the bit-mapped indicia image 96 is stored in DLL 40 which can only be accessed by executable code in DLL 40. Furthermore, only the executable code of DLL 40 can access the fixed graphics image 90 of the indicia to generated bit-mapped indicia image 96. This prevents accidental modification of the indicia because it would be very difficult for a normal user to access, intentionally or otherwise, the fixed graphics image 90 of the indicia and the bit-mapped indicia image 96.

The present invention is suitable for generating a batch of tokens for addresses in a mailing list rather than entering such list of addressees one at a time. The batch of tokens are part of a batch of transaction records, that are indexed in the transaction file in the DLL storage area 41, which are later used to generate indicia images when printing envelopes for the mailing list. Such batch processing would be useful, for example, to production mailers which often have databases of addresses from which to generate mail. These databases are usually pre-processed and sorted to take advantage of postal discounts and recipient profiles for direct marketing opportunities.

In an alternate embodiment, a PC-based open metering system is part of a network with the vault connected to a server PC and the user requesting postage from a user PC. The token generation process would proceed as previously described except that the vault functions, including token generation, would occur in the server PC or the vault card connected thereto. The user PC would store the transaction records, including issued tokens, on its hard drive and would generate indicia corresponding thereto. The server PC also stores a record of all transactions for backup and disaster recovery purposes. This configuration would allow multiple users to send a letter to the same addressee without the token generation being inhibited.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A method of reissuing digital tokens in a metering system comprising the steps of:

calculating a digital token using the predetermined postal information including postage amount and piece count;

debiting postal funds by the postage amount;

issuing the digital token to be used in generating an indicum;

storing the digital token and the predetermined postal information as part of a transaction record; and reissuing the digital token from the transaction record to regenerate the indicum for the mailpiece when the indicium generated from the digital token is not successfully printed on the mailpiece.

2. The method of claim 1 wherein the step of reissuing the digital token is based on the piece count.

3. The method of claim 1 comprising the further step of:

finding the transaction record corresponding to the digital token according to the piece count contained the transaction record.

4. The method of claim 1 wherein the transaction record is stored on a hard drive of a PC meter.

5. The method of claim 1 wherein the transaction record is stored in a metering unit.

6. The method of claim 1 comprising the further step of:

maintaining a plurality of transaction records in a transaction record file for a predetermined time or count.

7. A method of reissuing digital tokens in a metering system comprising the steps of:

sending from a host processor to a vault that is operatively coupled to the host processor predetermined postal information, including piece count, and a request for at least one digital token;

calculating in the vault in response to the request for tokens at least one digital token using the predetermined postal information;

debiting postal funds in the vault;

issuing the digital token to the host processor;

storing the digital token and the predetermined postal information as a transaction record in the host processor for subsequent generation and printing of an indicum;

generating in the host processor a bitmap image of the indicum comprising a graphical image of the digital token and the predetermined postal information and storing the indicum in the host processor for subsequent printing; and reissuing the digital token from the transaction record in the host processor when the generated bitmap image has not been successfully printed.

8. A method of reissuing digital tokens in a metering system comprising the steps of:

calculating in a metering unit in response to a request for a digital token at least one digital token using predetermined postal information including piece count;

debiting postal funds in the metering unit;

issuing the digital token; and storing the digital token and the predetermined postal information as a transaction record in the metering unit for subsequent generation and printing of an indicum.

generating unit a bitmap image of the indicum comprising a graphical image of the digital token and the predetermined postal information and storing the indicum for subsequent printing;

reissuing the digital token from the transaction record in the metering unit when the generated bitmap image has not been successfully printed.

* * * * *